United States Patent [19]

Leslie et al.

[11] 3,978,748

[45] Sept. 7, 1976

[54] FLUID JET CUTTING SYSTEM

[75] Inventors: Elmer N. Leslie; Bobby L. Higgins, both of Dallas, Tex.

[73] Assignee: Camsco, Inc., Richardson, Tex.

[22] Filed: Dec. 30, 1975

[21] Appl. No.: 645,158

Related U.S. Application Data

[62] Division of Ser. No. 527,098, Nov. 25, 1974.

[52] U.S. Cl. ..... 83/53; 83/71; 83/177; 83/925 CC

[51] Int. Cl.[2] ..... D06H 7/00; B26F 3/00

[58] Field of Search ..... 83/53, 71, 177, 925 CC

[56] References Cited

UNITED STATES PATENTS

| | | | |
|---|---|---|---|
| 3,532,014 | 10/1970 | Franz | 83/177 X |
| 3,625,813 | 12/1971 | Eckelman | 83/177 X |
| 3,640,163 | 2/1972 | Giardini et al. | 83/177 X |
| 3,730,040 | 5/1973 | Chadwick et al. | 83/177 X |
| 3,769,488 | 10/1973 | Haslingler | 83/925 CC |
| 3,835,741 | 9/1974 | Anderson et al. | 83/925 CC |

*Primary Examiner*—J. M. Meister

*Attorney, Agent, or Firm*—Sughrue, Rothwell, Mion, Zinn and Macpeak

[57] ABSTRACT

Apparatus and method are disclosed utilizing a high strength fluid jet in an operative cutting system. A computer driven carriage and nozzle movable on the carriage effectuate cutting in the X-Y direction and a sensor arrangement is used to position the nozzle in the Z-direction. The workpiece rests on a flexible wire bed which supports the workpiece and at the same time allows a fluid catcher to pass under the workpiece in registration with the nozzle. A support channeled for allow for movement of the fluid catcher provides support for the workpiece in the area of the cut.

16 Claims, 7 Drawing Figures

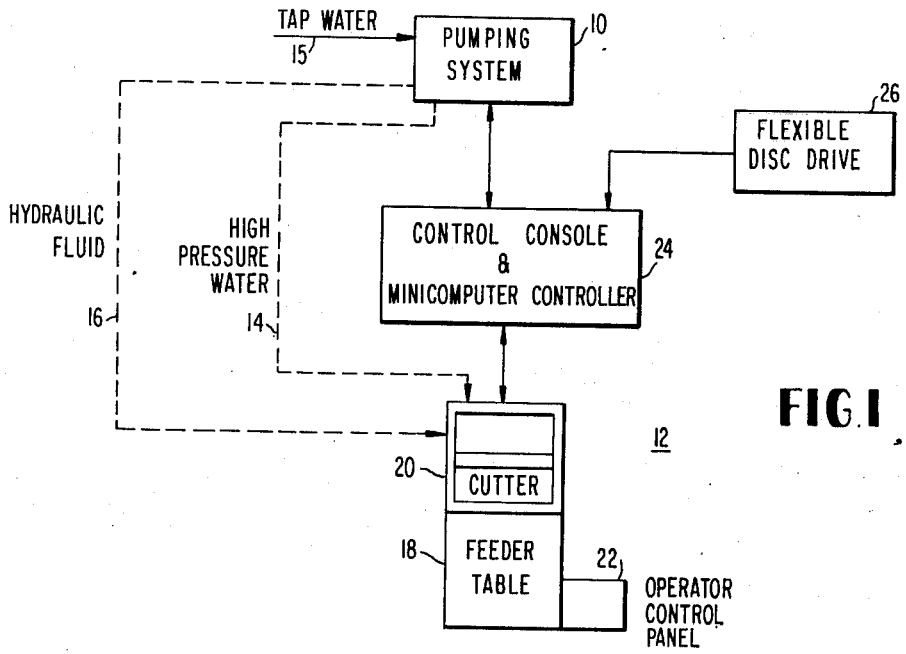
FIG. 1
FIG. 4
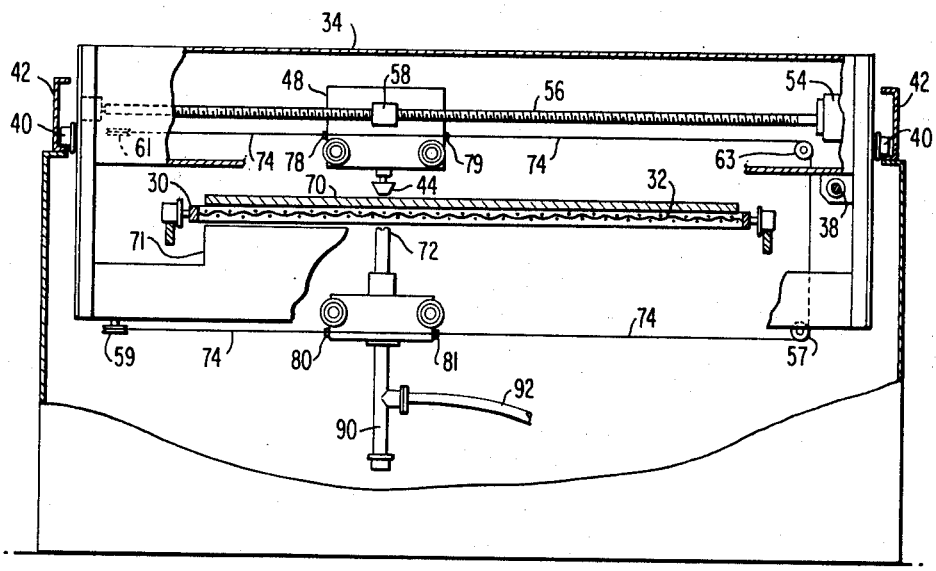

FLUID JET CUTTING SYSTEM

This application is a division of application Ser. No. 527,098, filed Nov. 25, 1974.

BACKGROUND OF THE INVENTION

The present invention relates to a system for high volume, accurate cutting of both hard and soft materials using a fluid jet cutting device. In particular, the present invention is directed toward a controlled cutting system having omnidirectional capabilities using water as the cutting agent.

The prior art is replete with devices and methods using high velocity liquid jets. Generally, as summarized in *Machine Design*, Feb. 22, 1973, pages 89-93, these techniques involve pressurizing a working fluid which is ejected using a high velocity discharge nozzle. U.S. Pat. Nos. 2,985,050 and 3,212,378 are representative of these prior art devices. The lack of success of these devices is attributed to the problem of dispersion of the working fluid upon ejection from the nozzle resulting in poor or irregular penetration for cutting along the prescribed path. Additionally, the work surface tends to become wetted and accordingly, in applications where depth of penetration, regularity of cut or absence of wetting become factors, these prior art devices are not suitable. Generally, hard materials such as ceramics, metals and lumber have been the subjects of interest for these prior art devices. U.S. Pat. No. 2,881,503 is also typical of this class of liquid cutters.

U.S. Pat. No. 2,006,499 demonstrates the converse, cutting of thin soft materials like paper sheets by low velocity jets in a environment where wetting is not a problem either because the material is already wet or because the thin sections of the cut will dry by evaporation very easily.

Attempts to introduce additives into the liquid to either reinforce the cut or shape the fluid to prevent dispersion have been attempted in the prior art as means of overcoming the problem of wetting in high velocity systems. U.S. Pat. No. 3,136,649 shows the use of a reinforcing material, such as a hardenable resin, to support the edges of the cut in a perforating system and U.S. Pat. No. 3,524,367 adds a long chain polymer to the fluid to improve cohesiveness and minimize dispersion of the fluid upon exiting from the jet. A variation is shown in U.S. Pat. No. 3,532,014 where the cutting rate of the fluid is optimized to volatize the retained fluid in the edges of the cut by heating due to frictional engagement of the material and the liquid jet. Such a system, while providing a solution to the problem of wetting, results in lower cutting rates and an inability to cut multiple layers of material.

For these reasons, high velocity liquid jet cutting of materials, especially soft goods such as fabrics has not been commercially used. Cutting techniques have continued to be centered around knife or die cutting. These systems continue to be wasteful of material and are not omnidirectional cutters thereby giving rise to the problem of maintaining proper blade angle. Likewise, the more exotic ideas such as laser cutting, while being omnidirectional in cutting, are restricted to a few well defined applications. Lasers, for example, are not suitable for cutting multiple layers because the heat associated with the cutting operation tends to bond the layers together. Hence, the prior art has failed to achieve a workable commercially successful omnidirectional cutting system for both hard or soft materials.

The prior art has generally used solid cutting tables as the only viable means of material support and the problem of wetting is obviously not solved by such equipment. The problem of material handling is also a function of the type of cutting table employed and the general lack of success in the exploitation of liquid cutters for all but the roughest cutting operations has precluded refinement of material handling techniques.

SUMMARY OF THE INVENTION

This invention combines the known properties of high velocity fluid cutting into a unique system for cutting to any shape or size either hard materials or layers of soft goods. The cutting system employs either direct computer control or preprogrammed tapes to direct the cutting head in any desired pattern and unique material handling systems are employed to facilitate either hard materials such as shoe soles, or soft materials typified by fabrics.

Accordingly, it is an object of this invention to provide a system for omindirectional cutting of either hard or soft materials.

Additionally, it is an object of this invention to provide a system whereby multiple layers of soft materials such as fabrics for the apparel industry may be cut omnidirectionally along any path.

It is another object of this invention to provide a system whereby multiple layers of hard materials such as shoe soles may be cut omnidirectionally using multiple cuts in the workpiece.

A further object of this invention is to provide a material handling system for liquid jet cutting of materials without wetting of the material.

Yet another object of this invention is to provide a system of high velocity liquid jet cutting using ordinary tap water that is practical, reliable and economical to operate and maintain.

It is still a further object of this invention to provide a high velocity liquid cutting system that is fast, accurate and maximizes material utiliztion.

It is another object of this invention to provide a computer control system that positions and directs movement of a liquid jet cutter to maximum efficiency without the disadvantages of knife-like cutters and die equipment.

These and other objects will become apparent to those skilled in the art by reference to the following description and drawings.

IN THE DRAWINGS

FIG. 1 is a functional schematic of the system comprising the invention;

FIG. 4 is a side view of the components forming the cutting apparatus taken from section 4 from FIG. 3;

DESCRIPTION OF THE PREFERRED EMBODIMENT

Figure 2:
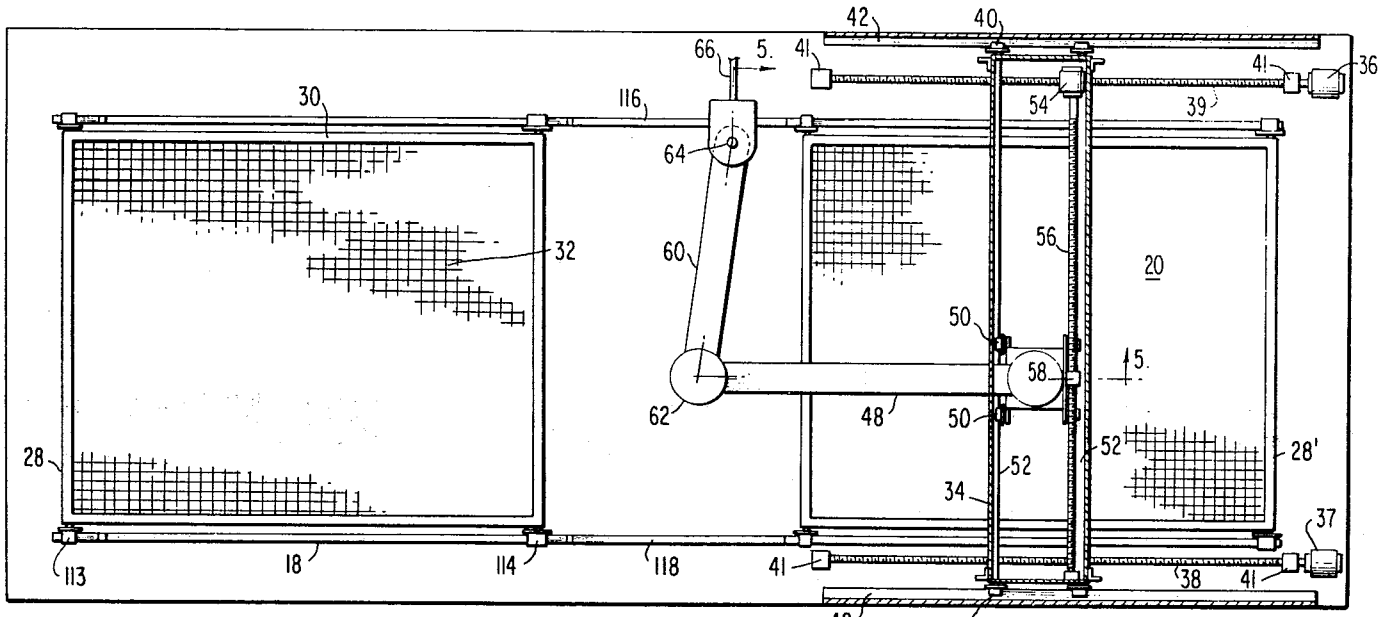
FIG. 2 is a top view of the cutting table and associated equipment showing one type of material handling system.

FIG. 1 shows, in a block diagram, the basic components of the fluid jet cutting system. A pumping system 10 is the source of water under pressures up to about 60,000 psi which is fed to the cutter 12 by a transport system 14. The pump uses tap water shown with input line 15 in conjunction with an hydraulic driven intensifier to generate the necessary water pressures. Although not shown, the pump 10 can be used to drive multiple cutting tables. Additionally, hydraulic fluid, at a pressure of approximately 3,000 psi, is tapped from the pumping system and transferred to the cutter by means of transport mechanism 16. The cutter system 12, cutting across a horizontal plane, has a feeder table section 18 and a cutting section 20 controlled by an operator panel 22. The actual control of the liquid jet cutter, in terms of the cutting path, is controlled by computer 24 such as a DATA General NOVA 2/4 or similar minicomputer. The computer utilizes typically a flexible disk drive input 26 such as a MEMOREX or other commercially available inexpensive storage device which contains the data relative to the cutting operation to be performed for a particular pattern or set of patterns.

Figure 3:
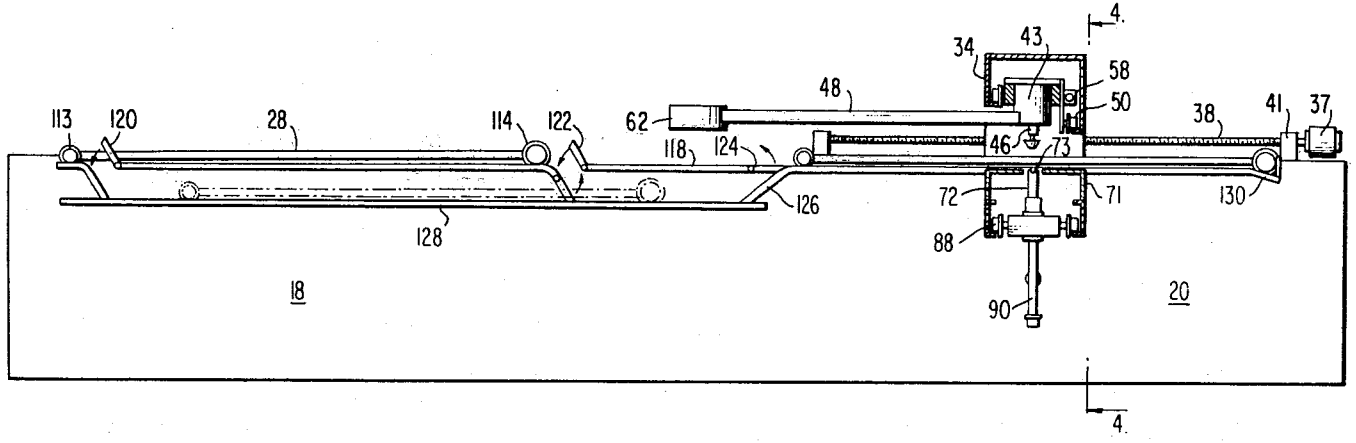
FIG. 3 is a side view of the cutting table shown in FIG. 2.

Turning now to FIGS. 2 and 3, there is shown a first preferred embodiment of the cutter table and material handling means. In this embodiment, preferred for use with slab type goods such as layers of flexible cloth, semi-rigid materials such as shoe leather or rigid materials typified by fiber boards, the workpiece is slab loaded at the feeder table 18 onto a tray. The tray, typically about 60 to 72 inches on a side, has a frame 30 and a grid of spring steel 32.

The wires 32, spring steel about .015 inch in diameter support the workpiece while facilitating the cutting operation by preventing splash back and wetting of the workpiece. The wires are held in tension at a loading of approximately one-half the yield point of the steel. At this loading the grid adequately supports the material to be cut, but has sufficiently elasticity to deflect when the fluid passes directly over it, thereby not being severed by the force of the fluid.

The use of a wire grid has been found to overcome one of the prime disadvantages of prior systems, splashback. As just pointed out, support of the workpiece is essential and in systems where merely straight cuts were being made, such as cutting logs, the material could be passed under the cutter on a table with a fixed discharge duct directly opposite the nozzle. However, for complex cutting operations, such as fabric patterns, it is obvious that a solid table cannot be employed least the material be completely saturated by the cutting fluid. One way to avoid the problem would be to hang the material vertically without a backing and cut horizontally, however, material handling problems result which make this type of cutting impractical for flexible goods. The use of a horizontal bed with the cutting action vertical is preferred and the use of a wire support bed makes this type of operation feasible. Trays, such as shown in FIG. 2, may be fabricated using a wire pattern of size and strength to facilitate the support of the material and to prevent pieces, once cut, from falling through the wires.

Each tray is movable over a track, to be described later, through a gate system to the cutting area 20. Resting over the cutting area is a carriage 34, which is driven over the X-axis by stepper motors 36, 37, which turn lead screws 38 and 39. A ball nut, not shown, but mounted on carriage 34, receives the lead screw and in response to rotation thereof, the carriage is driven forward or backward in the X-direction. The lead screws are supported by bearings mounted in bearing blocks 41. The carriage itself rides on four rollers 40 positioned at each corner for movement on rails 42 at the periphery of the cutting surface. The housing 43 contains the cutting nozzle 44 with associated fluid handling conduits 46 coupled to arm 48. The nozzle 44 and associated hardware are mounted for movement in the Y-direction, that is along the carriage, by a series of rollers 50 riding on rails 52. In a manner identical to the X-direction drive, the housing 42 moves in response to stepper motor 54, driving lead screw 56 through ball nut 58 to effectuate a linear motion in the Y-direction. The positioning of the nozzle 44 anywhere in the cutting area is then a direct function of the action of stepper motors 36, 37 and 54 which are controlled by computer 24.

At the end of lead screws 38, 39 are optical encoders, not shown, which rotate with the lead screws at the bearing blocks 41. A pair of sensors measure lead screw rotation in response to encoder action and the output is monitored by the computer 24. In normal operation, the lead screws turn in synchronism, hence, the encoder outputs would be the same. However, if one stepper failed or the carriage 34 in some way jammed, the difference in rotational rates of the lead screws would be noted by the computer and the operation in progress would be halted to prevent damage to the system. Typically, X-Y position resolution to 0.0025 inch with contour accuracy of 0.005 inch can be maintained. It is evident that for larger applications a variety of other X-Y positioners may be used in place of the stepper motor, lead screw arrangement shown. Rack and Pinion drives, gearing or drive belt arrangement may be substituted with the choice of positioners being a function of cutting table size, accuracy and desired dynamic performance considerations.

Figure 5:
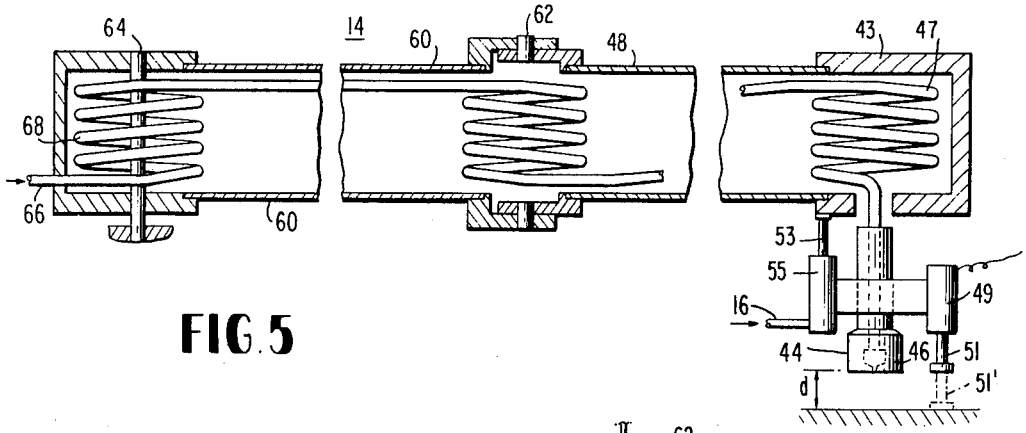
FIG. 5 is a side view from section 5 in FIG. 2 of a flex arm to supply high pressure fluid to the nozzle and other elements of the fluid port system.

Water under pressure is fed from the pumping station 10 to the nozzle 44 by transport mechanism. As shown in FIGS. 2 and 3, two arms 48 and 60 are coupled at joints 62 and 64 and form links in the transport mechanism 14. Referring now to FIG. 5, this fluid transport mechanism is shown in greater detail. Water enters the transport system 14 through stainless steel tube 66 and is convoluted to form a stainless steel torsion spring 68 at pivot point 64. Tube 66 continues through arm 60 until a second joint 62 is reached where the tube is convoluted to form a second torsion spring. Arms 48 and 60 rotate about joint 62 as the carriage and nozzle move. Arm 48 terminates at housing 46 on the housing 43 in which a third convolution 47 is formed. This third stainless steel spring, as shown, permits movement of the nozzle 44 relative to the workpiece.

Attached to the nozzle is sensor 49 which has an extending probe 51. The probe is lowered, as shown at 51', and the nozzle assembly is lowered by hydraulic piston assembly 53-55 which receives hydraulic fluid bled from the pumping system through line 16. When the probe senses the workpiece 70, the piston action is stopped and the nozzle is then positioned a predetermined distance d above the workpiece. In operation, the distance d may vary from 0.1 inch to just barely resting on the workpiece. The probe 51 is then retracted back into sensor 49. As a fail-safe, an hydraulic analog is also used to prevent the nozzle head assembly 44 from driving through the workpiece should the sensor 49 fail to operate. The use of a continuous stainless steel tube as shown in FIG. 5 is a material improvement over the prior art knuckle joints which have heretofore been employed. The prior art types of joints have been difficult to assemble, tend to seize with a loss of pressure and have short seal lives at the joints.

Referring now to FIGS. 3 and 4, the nozzle 44 is shown in position to make a cut through workpiece 70 and a foot 71 provides support for the material 70 resting on the wire bed 32. The foot is on the underside of the carriage 43 to give proper registration for the material in the area of the cut and has a channel 73. Disposed in the channel 73 is a water catcher 72 mounted for movement in synchronization with nozzle 44. To facilitate this movement, the catcher is driven by a wire rope and pulley mechanism. Wire rope 74 is attached to the housing 43 at points 78 and 79, slides on a series of pulleys 57, 59, 61, 63, and is fastened to the catcher at points 80, 81. Frames on foot 71 provide support for the catcher and rollers 88 facilitate movement. In response to movement of the nozzle 44 the catcher 72 maintains accurate alignment for the receipt of expelled fluid. Also, a lead screw arrangement, similar to that for the carriage, may be used.

The catcher 72 must completely surround the jet for purposes of noise suppression and reduction of entrained air. A tubular arrangement minimizes air entrainment, reduces the noise levels to acceptable values and eliminates splashback. It is of sufficient length to reduce the energy density of the stream by radial dispersion. A trap 90 is provided to form a water buffer for the high velocity discharge to further dissipate the jet and water is drained through line 92. The system in operation utilizes approximately one hundred gallons of water per hour and hence the economies of scale do not normally dictate recycling. However, in cutting operations such as fiberboard or asbestos, a fine slurry may result and recycling to recover the residue may be economical. The head of the catcher is places to ride in contact with the material to be cut to reduce the free air path and prevent bottom wetting. In operation, the catcher will slightly deflect the wires 32 as it passes them, but they being under tension will spring back in position.

Because the thickness of the material 70 may vary, the position of the nozzle 44 must change so that for all cutting operations the nozzle 44 may rest barely on the workpiece or to a small clearance from the material. The reduction of the free air path from nozzle 44 to catcher 72 is further reduced by positioning of the nozzle near the material. Water exiting the nozzle travels at supersonic velocities and the shock wave produced in free air would give rise to unacceptable noise levels. Also, placing the jet close to the workpiece enhances the efficiency of cutting, hence, the position of the nozzle in the Z-axis becomes critical for a workable system. As shown in FIG. 5 and discussed above, the sensor arrangement 49, 51 facilitates this positioning.

Referring back to FIGS. 2 and 3, a first preferred material handling system is shown. Tray 28 is shown on the feeder table 18 with a second tray 28' in the cutting area 20. Each tray moves on a set of wheels 113, 114 on rails 116 and 118. As shown in FIG. 3, a series of gates 120, 122 and 124 is used to move and position trays 28 and 28'n vis-a-vis the feeder and cutting stations. When gates 120, 122 and 124 are closed with respect to rails 116 and 118, tray 28 is free to roll into the cutting area 20. Preceding this operation, gate 124 is open and tray 28' is permitted to roll down ramp 126 into a lower position on the feeder table on rails 128. Once in the cutting area, a slight recession 130 in rails 116 and 118 maintains the tray in position.

Wheels 113 are smaller in diameter than wheels 114 to cant the tray thereby permitting clearance of the foot 71 when rolling into the cutting area. When the tray reaches the limit of travel, wheels 114 fall into depression 130 and the tray is then in a horizontal position.

In this embodiment a shuttling of trays is effectuated, one being unloaded with cut material and reloaded with raw stock while the cutting operation takes place on the cutter tray at the cutting station. In operation, the minicomputer controls both the cutting sequence in accordance with well known machine control techniques and the feeder table cycling. Cutting speed and nozzle acceleration are functions of the materials to be cut. A manual override is provided at the operator control station 22 for both X and Y direction slew as well as feeder table cycling.

Figure 6:
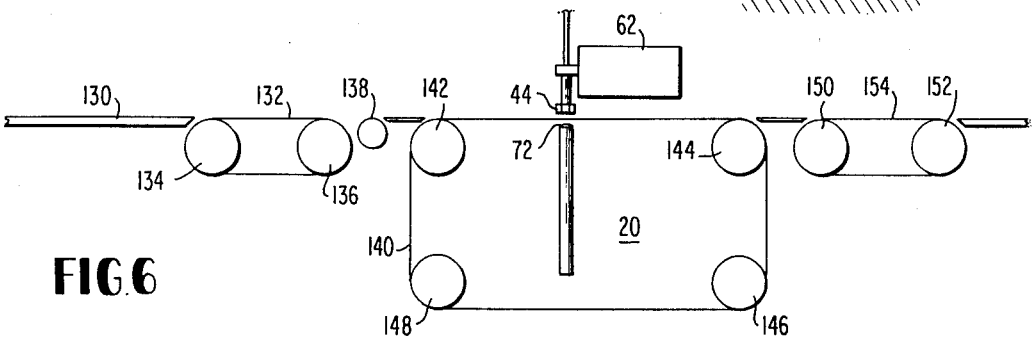
FIG. 6 is a schematic view of a second preferred material handling system employing continuous belts.
Figure 7:
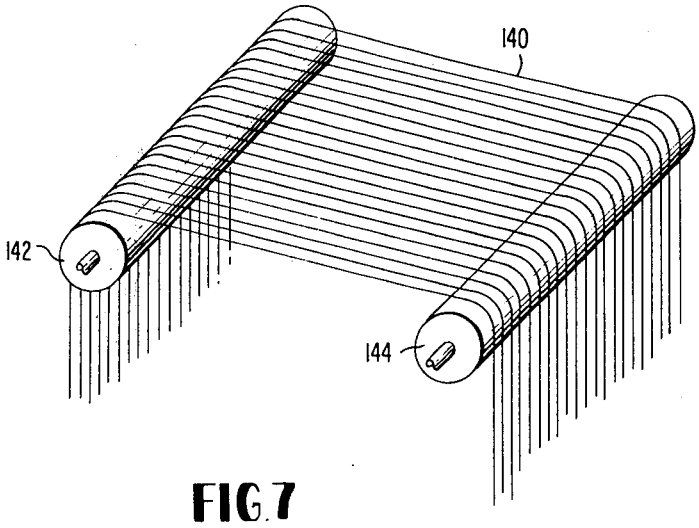
FIG. 7 is a schematic showing the use of a wire grid to support the material in the cutting area of the embodiment shown in FIG. 6.

A second preferred embodiment, desirable for cutting continuous roll goods, is shown in FIGS. 6 and 7. In this embodiment, the nozzle 44, fluid transfer system joint 62 and catcher 72 is shown in schematic fashion. A spreading table 130 is used initially to sort and organize the material to be cut. A feed belt 132 driven by rollers 134, 136 is utilized to move the material off the spreading table and into the cutting area. To monitor the quantity of material moving into the cutting area, a displacement roller 138 is disposed between the feed belt and the cutting area. The roller 138 is connected to a shaft encoder, not shown, which in response to rotational movement of the roller 138 provides a linear output representative of the material passing over the roller.

The cutting station 20 utilizes, as shown in FIG. 7, a wire support net 140 which is tensioned by a series of rollers 142, 144, 146, 148. The steel wire, stressed to about one-half of the yield point, supports the material in the cutting area and once the operation is complete, rollers 150-152 may be energized to turn removal belt 154 to effectuate a removal of cut goods and residue of the bulk material. In operation, a continuous roll of material is fed into the cutting station in incremental quantities to fill the cutting area by energizing rollers 134, 136, 142, 144, 150 and 152. Computer control of the nozzle 44 movement drives the cutter in a predetermined path to make the prescribed cuts in the material. As in all embodiments of this invention, the nozzle may be positioned to cut anywhere in the cutting area, and is not restricted to starting at the edge. The cutting can be either continuous, in a path, or intermittent, starting and stopping at various locations and then having the water flow stopped while the head is repositioned for another cut.

It will be understood that modifications and variations may be effected without departing from the scope of the invention as set forth in the following claims.

What is claimed is:

1. Apparatus for cutting a workpiece comprising:

a. a source of fluid;

b. means for intensifying the pressure of said fluid coupled to said source;

c. means for supporting the workpiece comprising a plurality of flexible supports;

d. a nozzle movable in relation to said support means;

e. conduit means communicating between said nozzle and said intensifying means for supplying fluid under pressure to said nozzle;

f. means to effectuate a discharge of fluid from said nozzle to cut through the workpiece;

g. means disposed under said support means, on the side of the workpiece opposite the nozzle and movable in correspondence with the movement of said nozzle to receive the fluid discharge from the nozzle and thereby reduce the splashback of fluid on the workpiece;

h. a sensor for determining the distance between the nozzle and the workpiece; and i. means for moving the nozzle to vary the distance between the nozzle and the workpiece.

2. The apparatus of claim 1 wherein the means for effectuating discharge of fluid includes a computer, said computer being programmed to move said nozzle in accordance to a preselected cutting path.

3. The apparatus of claim 2 including data storage means operably coupled to the computer for providing data input.

4. The apparatus of claim 1 wherein the fluid is water and the intensifier generates pressures in the order of 60,000 psi.

5. The apparatus of claim 1 wherein the means for supporting the workpiece includes a plurality of wires disposed under the workpiece and tensioned sufficiently to support the workpiece, but elastic to deflect under the application of fluid pressure without being cut by the fluid.

6. The apparatus of claim 5 wherein the wires form a grid and are made from spring steel in the order of 0.015 inch in diameter.

7. The apparatus of claim 1 wherein the workpiece is a rigid material such a shoe material or wallboard.

8. The apparatus of claim 1 wherein the means for supporting the workpiece includes a rigid member movable in registration with said nozzle and under said workpiece.

9. The apparatus of claim 1 wherein the workpiece is comprised of multiple layers of thin flexible materials such as fabric.

10. The appratus of claim 1 including means for moving said workpiece to said support means and removing said workpiece when the cutting operation has been completed.

11. The apparatus of claim 10 wherein said means for moving the workpiece includes a series of conveyors to move the workpiece to and from the means for supporting said workpiece.

12. A method of cutting a workpiece, comprising the step of:

a. generating fluid under pressure in the range of 30,000 to 60,000 psi;

b. transporting said fluid under pressure in a cutting nozzle;

c. positioning and supporting a workpiece under said nozzle;

d. directing the stream of fluid through said nozzle to cut through the workpiece;

e. moving said nozzle in a predetermined path to cut a pattern through said workpiece;

f. positioning a device for receiving fluid expelled from the nozzle and moving said device in correspondence with the movement of the nozzle; and g. sensing the distance between said nozzle and said workpiece and adjusting the nozzle to maintain a selected distance between it and the workpiece.

13. The method of claim 12 wherein the step of sensing the distance between said nozzle and said workpiece includes the steps of lowering a probe mounted in position relative to the nozzle, moving the nozzle and probe toward the workpiece, and sensing when the probe strikes the workpiece.

14. The method of claim 12 wherein the movement of the nozzle is in response to signals from a computer to control movement of the nozzle in two orthogonal directions.

15. The method of claim 14 wherein the starting and stopping of the stream of fluid is controlled by said computer.

16. An apparatus for cutting a workpiece comprising:

a source of fluid;

b. means for intensifying the pressure of said fluid;

c. means for supporting the workpiece;

d. a nozzle movable in relation to the support means;

e. conduit means communicating between said nozzle and said intensifying means for supplying fluid under pressure to said nozzle;

f. means to effectuate a discharge of fluid from said nozzle to cut through the workpiece;

g. means disposed on the side of the workpiece opposite the nozzle to receive the fluid discharge from the nozzle and thereby reduce the splashback of fluid on the workpiece; and h. means for moving said workpiece to said support means and removing said workpiece when the cutting operation has been completed, including a series of trays, each tray positionable under said nozzle and each tray having a wire bed to support said workpiece, said trays being loaded and unloaded at locations adjacent to said means for supporting said workpiece.

* * * * *